United States Patent [19]

Sundin et al.

[11] 4,285,028

[45] Aug. 18, 1981

[54] BEDROOM LAMP WITH CLOCK OPERATED LAMP SWITCH

[76] Inventors: Glen Sundin, c/o George Spector, 3615 Woolworth Bldg., 233 Broadway; George Spector, 3615 Woolworth Bldg., 233 Broadway, both of, New York, N.Y. 10007

[21] Appl. No.: 48,720

[22] Filed: Jun. 15, 1979

[51] Int. Cl.[3] ..... F21V 21/30

[52] U.S. Cl. ..... 362/35; 362/234; 362/253; 362/276; 362/411; 362/806

[58] Field of Search ..... 362/35, 253, 276, 234, 362/411, 806

[56] References Cited

U.S. PATENT DOCUMENTS 3,368,067 2/1968 Paxinos ..... 362/253

*Primary Examiner*—Stephen J. Lechert, Jr.

[57] ABSTRACT

A combination bedroom lamp and clock, the clock including a time-controlled mechanism that trips an on-off switch in the electric circuit to the lamp, and the device additionally including a lamp operated projector for images upon a bedroom ceiling.

3 Claims, 2 Drawing Figures

BEDROOM LAMP WITH CLOCK OPERATED LAMP SWITCH

This invention relates generally to bedroom lamps and bedroom clocks.

Almost everyone has experienced the difficulty of trying to shut off an alarm clock in a morning darkness, before day break, particularly if a person does not want a continuing alarm sound to awake other persons nearby. If a person must get out of a bed so to get to the clock, the situation is even worse by bumping and stumbling against objects in the darkened room.

This situation is accordingly in need of an improvement.

Therefore it is a principal object of the present invention, to provide a combination alarm clock and bedroom lamp wherein when the clock alarm goes on, the clock at a same time turns on the lamp so a person can see in a morning darkness in order to turn off the alarm.

Another object is to provide a combination alarm clock and bedroom lamp wherein the clock can selectively turn on only the lamp, without an alarm, if so wished.

Still another object is to provide a combination alarm clock and bedroom lamp which additionally includes a soft light for use in an evening in case a person still has not fallen asleep, the soft light producing moving images on a ceiling, such as sheep for being counted, so to aid a person in falling asleep in a natural manner without the aid of sleeping pill drugs.

Figure 1:
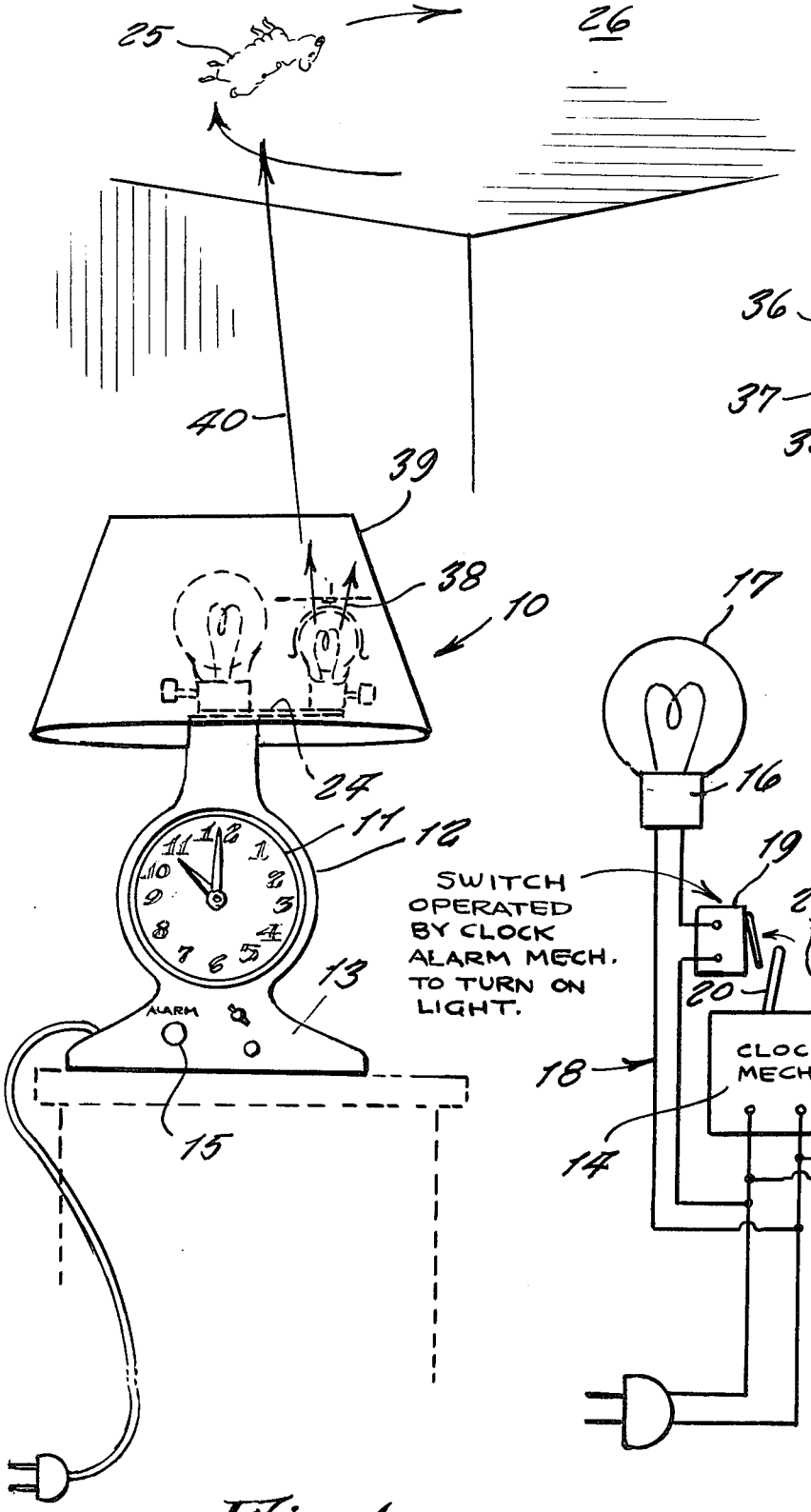
FIG. 1 is a side view of the invention in which a bedroom alarm clock also includes a lamp that automatically lights up when the alarm sounds in a morning, and the invention additionally including another small light which automatically shuts off in evening just before going to sleep, this small light flashing outline of moving sheep on a room ceiling so to be counted while trying to fall asleep.
Figure 2:
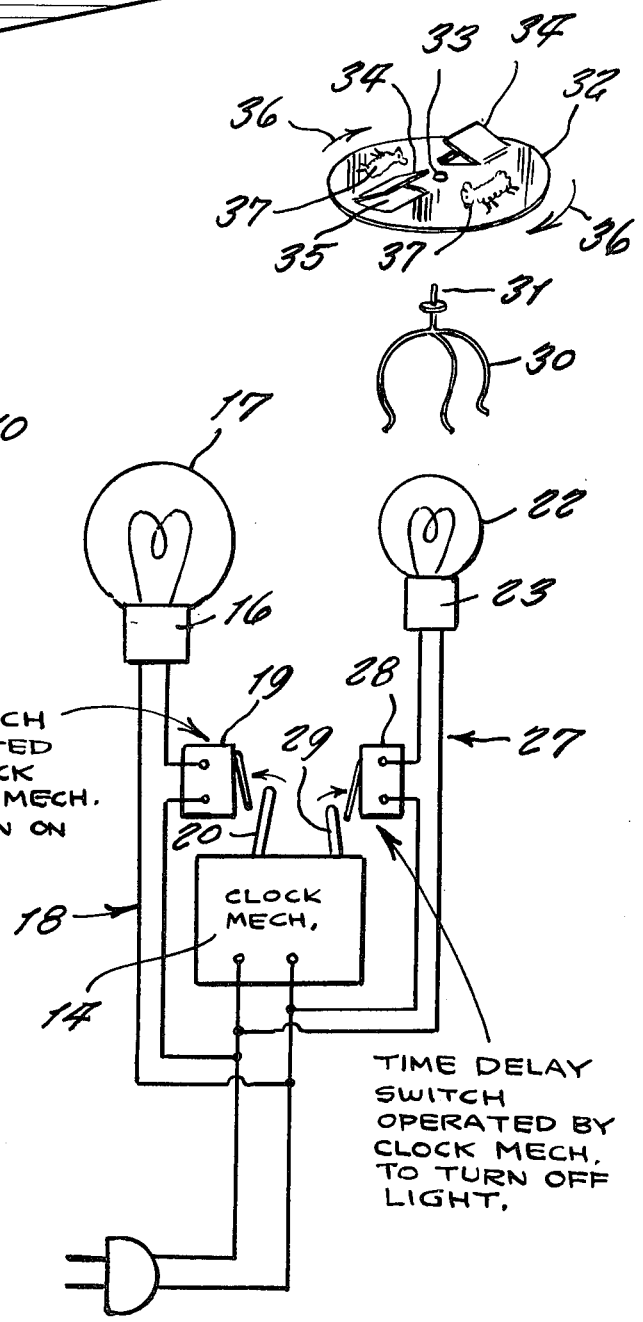
FIG. 2 is an electrical diagram of the invention.

Referring now to the drawing in greater detail, the reference numeral 10 represents a combination alarm clock and bedroom lamp wherein there is an alarm clock 11 contained within a case 12 that is integral with a lamp base 13. The clock mechanism 14 is electrically operated, and includes manual controls 15 for setting an alarm.

The lamp base also supports a lamp socket 16 for holding a lamp bulb 17 for adequate illumination of a bedroom and for reading while in bed. The lamp is in a circuit 18 that is interrupted by a switch 19, the switch being positioned so to be closed automatically by a lever 20 of the clock mechanism at a same time that the clock alarm is sounded. The switch 19 can be also manually operated when so wished so to put on the lamp for reading or illumination. However when the device is set for the light to go on automatically in the morning, the switch is left open when retiring, so that the lever 20 closes it in the morning.

A second lower wattage lamp 22 is supported in a lamp socket 23 on a bracket 24, the lamp being used to produce moving images 25 on a ceiling 26. The lamp is in a circuit 27 interrupted by a switch 28 which can be closed manually when retiring so to produce the images. The switch is positioned so to be automatically opened by a lever 29 of the clock mechanism after a specific length of time for operation, during which time a person may have gone to sleep.

The lamp 22 has a cage 30 clipped thereupon having an upward shaft 31 on which a transparent plastic disc 32 is placed, a hole 33 of the disc receiving the shaft. Upward inclined vanes 34 cut in the disc produce openings 35 through which lamp heat rises, strikes the vanes and causes the disc to rotate on the shaft as indicated by arrows 36. Designs 37 of sheep or the like are printed with opaque paint on the disc, so that in operative use, as the disc rotates the image of the designs 37 are projected on the ceiling, which a person in bed can see if he is as yet awake. As shown in FIG. 1, the light rays 38 from the lamp 22 strike the lamp shade 39, so are not projected on the ceiling. The light rays 40 however pass through the top opening of the lamp shade to the ceiling. Thus the sheep images are shown travelling only across an arc, instead of in a full circle, after which they disappear so that the images may be counted as they go by.

We claim:

1. A bedroom lamp with clock operated lamp switch, comprising in combination, an electric alarm clock having a clock mechanism said clock being in a case integral with a lamp base, a first lamp in a socket upon said lamp base, said first lamp being in a circuit interrupted by a first switch positioned for being automatically closed by a first lever of said mechanism when an alarm of said clock is sounded, and said bedroom lamp additionally including image producing means on a ceiling of a bedroom, said mechanism controlling operation of said means.

2. The combination as set forth in claim 1, wherein sai means comprises a second lamp in a circuit interrupted by a switch positioned to be opened by a second lever of said mechanism, and said means additionally including a transparent disc rotatable on a shaft over said second lamp, said disc having inclined vanes over openings therein, and designs imprinted in opaque paint on said disc.

3. The combination as set forth in claim 2 wherein said second lamp is positioned so that light rays only through one portion of said disc strike said ceiling.

* * * * *